United States Patent [19]

Brink

[11] Patent Number: 4,576,351

[45] Date of Patent: Mar. 18, 1986

[54] PORTABLE STROKE VICTIMS ARM REST

[76] Inventor: T. A. Brink, Rembrandstraat 96, 5301 SA Zaltbommel, Netherlands

[21] Appl. No.: 621,156

[22] Filed: Jun. 15, 1984

[51] Int. Cl.[4] ..... A47C 7/54

[52] U.S. Cl. ..... 248/118; 248/214; 248/279; 248/287; 297/194; 297/416; 128/77

[58] Field of Search ..... 248/118, 118.1, 118.3, 248/274, 276, 279, 287, 214, 218.4, 244, 298, 118.5; 297/194, 411, 412, 413, 416; 128/77

[56] References Cited

U.S. PATENT DOCUMENTS

| | | | |
|---|---|---|---|
| D. 262,911 | 2/1982 | Weddell | 248/118 |
| 443,839 | 12/1890 | Steinhauer | 248/118 |
| 561,562 | 6/1896 | Brownson | 248/118 |
| 571,936 | 11/1896 | Soto | 248/118.1 |
| 927,321 | 7/1909 | Bond | 248/214 |
| 1,072,858 | 9/1913 | Kiefer | 248/214 |
| 1,465,491 | 8/1923 | Smith | 248/118 |
| 1,715,862 | 6/1929 | Payton | 297/413 |
| 1,892,048 | 12/1932 | Genung | 297/412 |
| 2,325,292 | 7/1943 | Westrope | 248/118 |
| 2,477,898 | 8/1949 | Rehman | 248/118 |
| 2,614,558 | 10/1952 | Lovell | 248/118 |
| 2,696,868 | 12/1954 | Miller | 297/411 |
| 2,711,122 | 6/1955 | Klumpp | 248/298 |
| 3,103,386 | 9/1963 | Kerr | 297/416 |
| 3,323,144 | 6/1967 | Ferris | 297/416 |

FOREIGN PATENT DOCUMENTS

| | | | |
|---|---|---|---|
| 1109991 | 2/1956 | France | 248/118 |

*Primary Examiner*—J. Franklin Foss
*Assistant Examiner*—Robert A. Olson
*Attorney, Agent, or Firm*—Conlon & Kerstein

[57] ABSTRACT

A portable stroke victim's arm rest is provided to provide multi-positional means of comfort for the victim's arm and in particular to prop the victim's arm at an incline to prevent accumulation of fluids in the hand and wrist area. The portable stroke victim's arm rest provides means for stably receiving an arm of a chair as well as means for being stably secured on a flat surface such as a table or the like.

7 Claims, 5 Drawing Figures

PORTABLE STROKE VICTIMS ARM REST

BACKGROUND

This invention pertains to an arm support for use by persons who have suffered a stroke. More specifically, a highly portable stroke victim's arm rest adapted to provide multi-positional means of comfort and which may be stably supported on an arm of a chair or sofa or on a flat surface such as a table or the like.

It has been recognized that many health and healing aids for the well being of humans have been uncomfortable, clumsy and cumbersome devices. The realization, that in order to bring about quicker and more successful results in the healing process as well as patient assistance for their own care, has resulted in a different approach in the health care industry with an emphasis on the patient. Part of the direction to this different approach lies in the development of new products which are portable, easy to use and more comfortable than previous products. To that end the present invention deals with a portable stroke victim's arm rest. This appliance is easy to use achieves greater results with less effort and is more comfortable than its predeceasers.

SUMMARY

The nature of this invention is directed to providing a portable stroke victim's arm rest that exhibits a multi-positional facet with great ease as well as being adapted for stable use on the arm of a chair or sofa along with a flat surface such as a table or the like. The invention provides the greatest of comfort and ease in use while allowing for the preferable position of the hand elevated above the elbow to prevent the accumulation of fluids in the hand and wrist area.

In accordance with the invention, u-shaped height adjusting members are operatively mounted with a support member and adapted to securely position the portable stroke victim's arm rest on an arm of a chair and works to raise and lower the ends of the support member to achieve various heights and angles. A contoured, cushioned arm support is moveably coupled to the support member which allows for further comfort positioning of the stroke victim's arm.

The invention provides a stable means of positioning the invention upon an arm of a chair, sofa or the like; or a flat surface such as a table. The u-shaped height adjusting members form a guide for stably receiving the arm of a chair and form a carriage for receiving a base member for stable positioning on a table. The guide of the u-shaped height adjusting members is generally u-shaped and is formed by the spaced parellel legs of the adjusting members and a stub shaft located medially between the ends of the leg members. The carraige of the u-shaped height adjusting members is formed by the spaced parallel legs, the stub shaft and the cross member located at one end of the parallel legs.

While the invention will be described in connection with a preferred embodiment, it will be understood that it is not intended to limit the invention to the embodiment. On the contrary, it is intended to cover all alternatives, modifications and equivalents as may be included within the spirit and scope of the invention as defined by the appended claims.

DESCRIPTION OF THE PREFERRED EMBODIMENT

Figure 1:
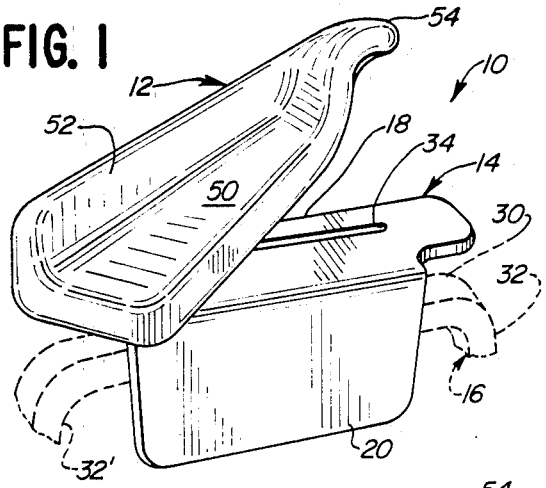
FIG. 1 is a perspective view of the invention herein showing the base member in phantom.

Referring now to the drawings, FIGS. 1–5, it is noticed that the portable stroke victim's arm rest is designated generally by the numeral 10 as provided for use by stroke victims. As it is understood, it is advisable for stroke victims to maintain their lower arm and hand in an inclined position to prevent an accumulation of fluids in the hand and wrist area. As it is known, if a stroke affects the right side of an individual's brain, the left portion of that individual's body is affected and vice versa. A certain amount of paralysis, while not dibilitating, may result and cause poor circulation in the extremities and limbs, and in particular, poor circulation at the outer portion such as the hands and wrists. Therefore, stroke victims are generally advised to carry a soft rubber ball which should be squeezed from time to time, not only to improve musculature in the extremity, but also to stimulate circulation. Further, when the stroke victim is sedentary, it is generally advised that he or she maintain the lower arm in a slightly inclined position in order to allow for a natural, gravity-encouraged, flow of fluids throughout the arm to prevent the accumulation of fluids in the hand and wrist areas. To accomplish this inclined positioning, as well as other comfort positions, this disclosure provides a contoured, cushioned arm support 12 that is moveably coupled to a support member 14. The arm support 12 is mounted for rotational movement providing the user with the most comfortable angle between his arm and his body. The support member 14, which also may be cushioned if desired, is adjustable to form various inclines as well as various height levels.

Figure 2:
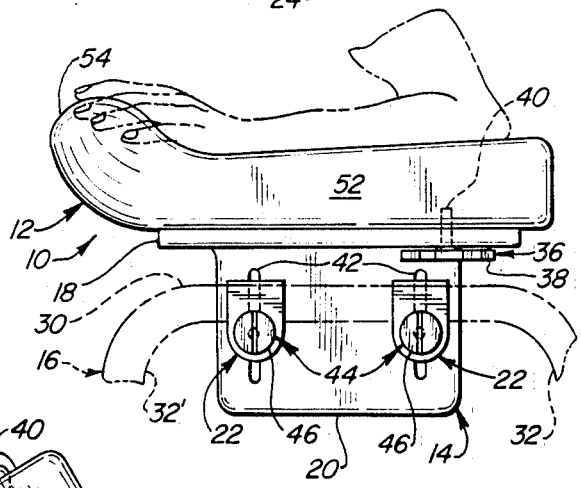
FIG. 2 is a side view of the invention showing the user's arm and base member in phantom.
Figure 3:
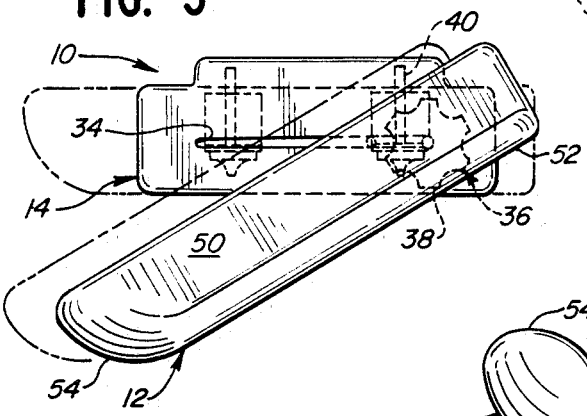
FIG. 3 is a top view of the invention showing the movable aspects in various positions in phantom.
Figure 5:
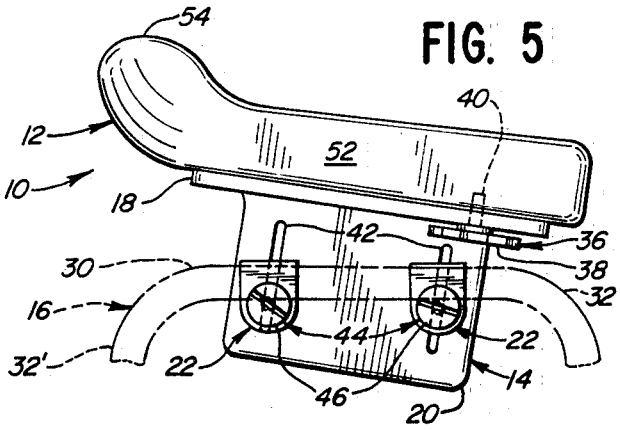
FIG. 5 is another side view showing the invention in an inclined position with the base member in phantom.

Specifically, FIGS. 1,2, and 5 disclose the portable stroke victims arm rest in various positions. FIG. 1, a perspective view, shows the arm rest 10 in a generally level position with the cushioned arm support 12 forming an acute angle with the support member 14. FIG. 2, a side view, discloses the arm rest in use by showing the arm of a stroke victim, in phantom, on the arm support 12. FIG. 3 shows the arm rest 10 at an elevated and inclined position. In each of these figures, a base member 16 is shown in phantom. The base member 16 is used as a stable mounting means for securely positioning the arm rest on a flat surface such as a table or the like. This aspect will be discussed more fully below.

Returning to FIG. 1, the support member 14 is comprised of a generally horizontal shelf member 18 and a generally vertical brace member 20. The brace member 20 eminates downwardly from an edge portion of shelf member 18 at substantially right angles forming a strong instrumentality to support the arm support 12 as well as a user's arm.

Figure 4:
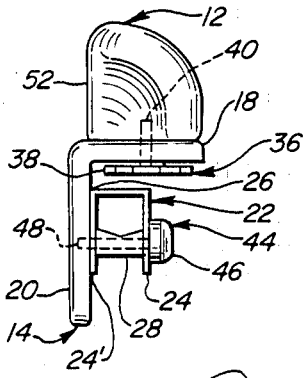
FIG. 4 is a front view of the invention.

As best seen in FIGS. 2,4 and 5 generally u-shaped height adjusting members 22 and 22' are operatively mounted with the support member 14. The height adjusting members 22 and 22′ are best seen in FIG. 4 and include spaced, generally parallel leg members 24 and 24′. Cross member 26 is connected between leg members 24 and 24′ at one end thereof. A hollow stub shaft 28 is also connected between leg members 24 and 24′ medially between the ends thereof. The leg members 24 and 24′ and stub shaft 28 form a guide or channel for stably receiving an arm of a chair, sofa or the like so that the user may use the the arm rest 12 in conjunction therewith.

Further, stub shaft 28 together with spaced legs 24 and 24′ and cross member 26 form a carriage securing the base member 16 as a part of the arm rest 10. In this arrangement the arm rest 10 can be stably and easily used on flat surfaces such as a table or like when the user deems necessary. The base member 16 includes an elongated beam member 30 with downwardly directed legs 32 and 32′ at the ends thereof. The legs 32 and 32′ are of such a length that they extend past the bottom end portion of the brace member 20 to allow for use on flat surfaces. The beam member 30 is securely positioned within the carriage of each height adjusting member and the bottom end portions of the legs 32 and 32′ are designed to stably match and conform to flat surfaces.

As best seen in FIGS. 1 and 3 the horizontal shelf member 18 of the support member 14 includes slot means 34. Slot means 34 is medially between the edge portions of the shelf member 18 and spanning near the end portions of the shelf underneath of the arm support 12 and projecting through the slot means 34 in association therewith guides longitudinal relative movement of the arm support 12 with respect to the support member 14 and further provides relative circular movement to aid in multi-positional comfort to the user. This is accomplished by a handle 38 and pin 40. The pin 40 screws in the arm support 12 and by rotating the handle into a locked position the arm support 12 is thereby rendered immobile with respect to the rest of the arm rest 10. To achieve a desired position of the arm support 12 with respect to the support member 14 the handle 38 is rotated to an unlocked position and the arm support 12 is rotated and moved longitudinally to its desired position (as best shown in FIG. 3). Once the desired position is attained the arm support 12 is locked into place as described above.

The arm rest's further multi-positional comfort comes from its ability to be raised and lowered to different heights as well as being able to form an incline. This incline is desirable to prevent an accumulation of fluids in the hand and wrist area. As shown in FIGS. 2, 4 and 5 the vertical brace 20 of the support member 14 includes groove means 42. Groove means 42 in association with screw means 44 of each adjusting member 22 allows for the various multi-positional heights and inclines achievable.

The screw means 44 comprise a knob 46 and lug 48 connected thereto. The lug 48 protrudes through the stubshaft 28 to engage groove means 42. The rotation of the knob 46 of each adjusting member 22 rotates lug 48 out of engagement with groove means 42 to an unlocked position allowing for vertical height adjustment of the arm rest 12 with respect to the object it is resting on (either a arm of a chair, a table, or the like). Once the desired height is achieved the knob 46 is rotated engaging the lug 48 in a locking condition with groove means 42 to securly maintain that desired height. Further, by providing adjusting members 22 and 22′ fore and aft of the arm rest 12 various incline positions are available as well as the various height levels.

Returning again to FIG. 1, the contoured cushioned arm support 12 is best shown. The arm support 12 includes a cushioned substantially horizontal support 50 with a cushioned upwardly extending wall support 52 substantially at right angles with the horizontal support 50 and situated along an outer edge thereof. The cushioned horizontal support 50 evolves into an elevated arcuate end portion 54 which is contoured for and accomodates the hand and wrist area in an elevated position with respect to the horizontal support 50. This design further enhances the natural, gravity-encouraged flow of fluids throughout the arm so necessary for the physical well being of stroke victims.

Thus it is apparent that there has been provided, in accordance with the invention, a portable stroke victim's conjunction with specific embodiments thereof it is evident that many alternatives, modifications, and variations will be apparent to those skilled in the art in light of the foregoing description. Accordingly, it is intended to enhance all such alternatives, modifications, and variations as set forth within the spirit and broad scope of the appended claims.

I claim:

1. A portable stroke victim's arm rest adapted to provide multi-positional means of comfort for the user's forearm in a position with the hand elevated above the elbow to prevent the accumulation of fluids in the hand and wrist area, the improvement comprising:

a support member having a generally horizontal shelf member and a generally vertical brace member eminating downwardly therefrom at substantially right angles from one side of said shelf member;

u-shaped height adjusting members operatively mounted with said support member being adapted to securely position said portable stroke victims arm rest on an arm of a chair, sofa or the like and further adapted to raise and lower the ends of said support member to achieve various heights and angles;

said u-shaped height adjusting members include spaced parallel leg members having a cross member therebetween at one end thereof;

a stub shaft located medially between the ends of the leg members, connected therebetween and forming with said leg members a guide for stably receiving an arm of a chair;

a contoured, cushioned arm support moveably coupled to said support member including a cushioned substantially horizontal support and a cushioned upwardly extending wall along said horizontal's support outer edge and being substantially at right angles therewith; and said substantially horizontal support evolving into an elevated arcuate end portion which is contoured for and accommodates the hand and wrist area in an elevated position with respect to the horizontal to thereby enhance the natural gravity encouraged flow of fluids necessary for the physical well being of stroke victims.

2. The portable stroke victim's arm rest as claimed in claim 1 wherein:

said vertical brace of said support member includes groove means; and screw means projecting through said stub shaft in agreement with said slot means to raise or lower said support member and secure a said support member at various levels.

3. The portable stroke victim's arm rest as claimed in claim 1 wherein:

said horizontal shelf member of said support member includes slot means; and adjusting and securing means connected with said contoured cushioned arm support and projecting through said slot means, guiding longitudinal relative movement of said contoured cushioned arm support with respect to said support member and providing an axis point for relative circular movement of said contoured, cushioned arm support with respect to said support member thereby providing the most comfortable angle between a user's arm and body.

4. The portable stroke victim's arm rest as claimed in claim 1 wherein:

a base member is provided in association with said u-shaped height adjusting members to provide a stable instrumentality for use of said portable stroke victim's arm rest on a flat surface such as a table or the like.

5. The portable victim's arm rest as claimed in claim 4 wherein:

said spaced parallel leg members, said cross member and said stub shaft of said u-shaped height adjusting member forms a carriage for securing said base member.

6. The portable stroke victim's arm rest as claimed in claim 5 wherein:

said base member includes an elongated member with downwardly directed legs at its end portions;

said legs, at their bottom end portions, designed to stably match and conform to flat surfaces; and said elongated member secured within said carriage when in use with said portable stroke victims arm rest.

7. The portable stroke victim's arm rest as claimed in claim 1 wherein:

two u-shaped height adjusting members are provided.

* * * * *